US008545008B2

(12) United States Patent
Asao et al.

(10) Patent No.: US 8,545,008 B2
(45) Date of Patent: Oct. 1, 2013

(54) RECORDING MEDIUM

(75) Inventors: Masaya Asao, Yokohama (JP); Hiroshi Asakawa, Ebina (JP); Hitoshi Nagashima, Kawasaki (JP); Takatoshi Tanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 224 days.

(21) Appl. No.: 13/111,213

(22) Filed: May 19, 2011

(65) Prior Publication Data

US 2011/0298879 A1 Dec. 8, 2011

(30) Foreign Application Priority Data

Jun. 4, 2010 (JP) ..... 2010-129271

(51) Int. Cl.

| | |
|---|---|
| ***B41J 2/01*** | (2006.01) |
| ***B41J 2/17*** | (2006.01) |
| ***B41J 2/325*** | (2006.01) |
| ***B05D 3/02*** | (2006.01) |

(52) U.S. Cl.

USPC ..... 347/105; 347/96; 347/172; 427/385.5

(58) Field of Classification Search

None

See application file for complete search history.

(56) References Cited

U.S. PATENT DOCUMENTS

| | | | | |
|---|---|---|---|---|
| 5,834,063 | A * | 11/1998 | Sato | 427/257 |
| 5,955,185 | A | 9/1999 | Yoshino et al. | |
| 5,965,252 | A | 10/1999 | Santo et al. | |
| 5,972,457 | A * | 10/1999 | Matsuishi et al. | 428/64.1 |
| 6,436,515 | B1 | 8/2002 | Ohbayashi et al. | |
| 6,613,419 | B2 | 9/2003 | Ohbayashi et al. | |
| 6,848,781 | B2 | 2/2005 | Ogino et al. | |
| 7,291,361 | B2 | 11/2007 | Ogino et al. | |
| 7,662,452 | B2 | 2/2010 | Nagashima et al. | |
| 7,846,516 | B2 | 12/2010 | Kamo et al. | |
| 7,867,586 | B2 | 1/2011 | Kamo et al. | |
| 7,972,665 | B2 | 7/2011 | Ogata et al. | |
| 2002/0025413 | A1 | 2/2002 | Ohbayashi et al. | |
| 2007/0231511 | A1 * | 10/2007 | Okuda et al. | 428/32.34 |
| 2008/0075898 | A1 | 3/2008 | Ogata et al. | |

(Continued)

FOREIGN PATENT DOCUMENTS

| | | | |
|---|---|---|---|
| EP | 1044823 | A2 | 10/2000 |
| JP | 7-232473 | A | 9/1995 |

(Continued)

OTHER PUBLICATIONS

Aug. 9, 2011 European Search Report in European Patent Appln. No. 11004321.3.

*Primary Examiner* — Stephen Meier
*Assistant Examiner* — Alexander C Witkowski
(74) *Attorney, Agent, or Firm* — Fitzpatrick, Cella, Harper & Scinto

(57) ABSTRACT

The invention provides a recording medium capable of inhibiting conspicuousness of scratches attached to the recording medium and preventing the occurrence of density unevenness in an image. The recording medium has a substrate and an ink receiving layer provided on the substrate, wherein substrate is a resin-coated substrate obtained by coating a base material with a resin, and wherein Ra2 is 0.3 μm or more and 2.5 μm or less and Ra1−Ra2 is 2.0 μm or more, where Ra1 is an arithmetic average roughness of a surface of the substrate son the side of the ink receiving layer as prescribed by JIS B 0601: 2001 and Ra2 is an arithmetic average roughness of the outermost surface of the recording medium as prescribed by JIS B 0601:2001.

8 Claims, 1 Drawing Sheet

(56) References Cited

U.S. PATENT DOCUMENTS

| | | | |
|---|---|---|---|
| 2010/0098866 | A1 | 4/2010 | Nagashima et al. |
| 2010/0183828 | A1 | 7/2010 | Asao et al. |
| 2010/0310795 | A1 | 12/2010 | Tanaka et al. |
| 2011/0059298 | A1 | 3/2011 | Nagashima et al. |

FOREIGN PATENT DOCUMENTS

| | | | |
|---|---|---|---|
| JP | 8-132731 | A | 5/1996 |
| JP | 9-066664 | A | 3/1997 |
| JP | 9-076628 | A | 3/1997 |
| JP | 2006-103103 | A | 4/2006 |
| WO | 2006/038666 | A1 | 4/2006 |

* cited by examiner

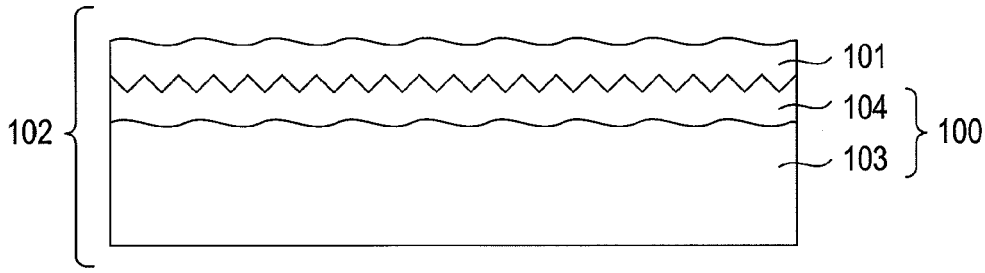
101
104
100
102
103

RECORDING MEDIUM

BACKGROUND OF THE INVENTION

1. Field of the Invention

The present invention relates to a recording medium.

2. Description of the Related Art

A recording medium having an ink receiving layer on a substrate is known as a recording medium for conducting recording by an ink jet recording method or with a felt-tip pen. As such a recording medium, there is a recording medium using a resin-coated substrate obtained by coating a base material with a resin for enhancing a glossy feeling (see Japanese Patent Application Laid-Open No. 2006-103103).

SUMMARY OF THE INVENTION

However, the recording medium described in Japanese Patent Application Laid-Open No. 2006-103103 has been difficult to inhibit conspicuousness of scratches caused on the recording medium and prevent the occurrence of density unevenness in an image. The reason for this is as follows.

In the resin-coated substrate obtained by coating a base material with a resin like the substrate of the recording medium described in Japanese Patent Application Laid-Open No. 2006-103103, the surface thereof is not intentionally roughened. Therefore, light reflected on the surface of the substrate is liable to be reflected in the form close to regular reflection toward the outermost surface of the recording medium, and so the scratches caused on the recording medium tend to be conspicuous.

On the other hand, when the outermost surface of the recording medium is roughened for inhibiting this, ink is liable to collect in dented portions present in the outermost surface of the recording medium to cause density unevenness in an image.

The profile of the outermost surface of a recording medium obtained by only applying an ink receiving layer coating liquid on to a substrate tends to follow the surface profile of the substrate to take a similar profile. In other words, when an ink receiving layer coating liquid is only applied after the surface of the substrate is roughened, the surface of an ink receiving layer, i.e., the outermost surface of the recording medium becomes rough, and so the density unevenness is liable to occur in an image.

Accordingly, it is an object of the present invention to provide a recording medium capable of inhibiting conspicuousness of scratches caused on a recording medium and preventing the occurrence of density unevenness in an image.

The present invention provides a recording medium comprising a substrate and an ink receiving layer provided on the substrate, wherein the substrate is a resin-coated substrate obtained by coating a base material with a resin, and wherein Ra2 is 0.3 μm or more and 2.5 μm or less and Ra1−Ra2 is 2.0 μm or more, where Ra1 is an arithmetic average roughness of a surface of the substrate on the side of the ink receiving layer as prescribed by JIS B 0601:2001 and Ra2 is an arithmetic average roughness of the outermost surface of the recording medium as prescribed by JIS B 0601:2001.

The present invention also provides a process for producing the recording medium, which comprises coating the substrate with an ink receiving layer coating liquid and thickening the ink receiving layer coating liquid to form an ink receiving layer.

According to the present invention, there can be provided a recording medium capable of inhibiting conspicuousness of scratches caused on the recording medium and preventing the occurrence of density unevenness in an image.

Further features of the present invention will become apparent from the following description of exemplary embodiments with reference to the attached drawing.

BRIEF DESCRIPTION OF THE DRAWING

The FIGURE illustrates a typical recording medium according to the present invention.

DESCRIPTION OF THE EMBODIMENTS

Preferred embodiments of the present invention will now be described in detail in accordance with the accompanying drawing. Incidentally, the present invention is not interpreted as being limited to these descriptions.

Recording Medium:

The recording medium according to the present invention is typically illustrated in FIGURE. The recording medium 102 is composed of an ink receiving layer 101 provided on a substrate 100. Another layer, for example, a precoat layer, which will be described subsequently, may be present between the substrate 100 and the ink receiving layer 101. The substrate 100 is a resin-coated substrate obtained by coating a base material 103 with a resin 104. The ink receiving layer may be provided on both sides of the substrate, and two or more ink receiving layers may be provided on the substrate. Great unevenness is intentionally provided on the surface of the substrate 100 on the side of the ink receiving layer. The ink receiving layer 101 is provided on this surface. In the present invention, the outermost surface of the recording medium, i.e., the surface of the ink receiving layer 101 on the side opposite to the substrate side in FIGURE, is intentionally smoothened. Specifically, the arithmetic average roughness (hereinafter referred to as Ra2) of the outermost surface of the recording medium as prescribed by JIS B 0601:2001 is 0.3 μm or more and 2.5 μm or less. In relation with the arithmetic average roughness (hereinafter referred to as Ra1) of the surface of the substrate 100 on the side of the ink receiving layer as prescribed by JIS B 0601:2001, Ra1−Ra2 is 2.0 μm or more.

Substrate:

The substrate of the present invention is a resin-coated substrate obtained by coating a base material with a resin.

As the base material, is mentioned, for example, a paper base material. The paper base material is obtained by using wood pulp as a main material and using synthetic pulp such as polypropylene or synthetic fiber such as nylon or polyester in addition to the wood pulp, as needed, to make paper. Examples of the wood pulp include LBKP, LBSP, NBKP, NBSP, LDP, NDP, and LUKP AND NUKP. Among these, LBKP, NBSP, LBSP, NDP and/or LDP, which are high in short fiber content, are favorably used more than the others. However, the amount of LBSP and/or LDP in the pulp is favorably 10% by mass or more and 70% by mass or less. The pulp is favorably chemical pulp (sulfate pulp or sulfite pulp) that contains a small amount of purities. Pulp subjected to a bleaching treatment to improve brightness is also favorable. A sizing agent such as a higher fatty acid or alkyl ketene dimer, a white pigment such as calcium carbonate, talc or titanium oxide, a paper-strengthening agent such as starch, polyacrylamide or polyvinyl alcohol, a fluorescent whitening agent, a water-retaining agent such as polyethylene glycol, a dispersant, and a softening agent such as quaternary ammonium may be suitably added into the paper base material. The basis weight of the paper base material is favorably 50 g or more and 250 g or less, particularly favorably 70 g or more and 200 g or less. The thickness of the paper base material is favorably 50 μm or more and 210 μm or less. The paper base material may be subjected to a calendering treatment during a paper making stage or after paper making to give high smoothness thereto. The density of the paper is favorably 0.7 g/m$^2$ or more and 1.2 g/m$^2$ or less (JIS P 8118). The stiffness of the paper base material is 20 g or more and 200 g or less under the conditions prescribed by JIS P 8143. The surface of the paper base material may be coated with a surface sizing agent. The pH of the paper base material is favorably 5 or more and 9 or less in terms of a value measured by the hot water extraction method prescribed by JIS P 8113.

The resin for coating the base material is favorably a polyolefin resin. As the polyolefin resin, is favorable polyethylene, polypropylene, polyisobutylene or a copolymer mainly formed of ethylene and propylene. Among these, polyethylene is favorable. As the polyethylene, is mainly favorably used low density polyethylene (LDPE) and/or high density polyethylene (HDPE). Linear low density polyethylene (LLDPE) or polypropylene may also be used. The polyolefin resin is favorably improved in opacity and brightness by adding rutile- or anatase-type titanium oxide into the polyolefin resin. The content of the titanium oxide is favorably 3% by mass or more and 20% by mass or less based on the polyolefin. The coating thickness of the resin is favorably 10 μm or more and 40 μm or less. The coating resin may contain a pigment high in heat resistance and/or a fluorescent whitening agent for adjusting a white ground (blank). Examples of the pigment include ultramarine blue, Berlin blue, cobalt blue, phthalocyanine blue, manganese blue, cerulian blue, tungsten blue, molybdenum blue and anthraquinone blue. Examples of the fluorescent whitening agent include dialkylaminocoumalins, bisdimethylaminostilbene, bismethylaminostilbene, 4-alkoxy-1,8-naphthalenedicarboxylic acid-N-alkylimides, bisbenz-oxazolylethylene and dialkylstilbenes.

Ink Receiving Layer:

The ink receiving layer of the present invention is favorably formed with an inorganic pigment and a binder. In particular, the ink receiving layer is favorably formed by coating a substrate with an ink receiving layer coating liquid containing a pigment and a binder and drying the coating liquid.

Examples of the inorganic pigment include alumina hydrate, alumina, silica, colloidal silica, titanium dioxide, zeolite, kaolin, talc, hydrotalcite, zinc oxide, zinc hydroxide, aluminum silicate, calcium silicate, magnesium silicate, zirconium oxide and zirconium hydroxide. Examples of organic pigments include styrenic plastic pigments, acrylic plastic pigments, polyethylene particles, microcapsule particles, urea resin particles and melanin resin particles. As the pigment, one of these inorganic and organic pigments may be used, or two or more pigments selected from these pigments as needed may be used in combination. Among these, alumina hydrate or silica is favorably used.

As the alumina hydrate, may be favorably used, for example, that represented by the following formula (X):

$$Al_2O_{3-n}(OH)_{2n}.mH_2O \quad (X)$$

(In the formula, n is any one of 0, 1, 2 and 3, and m is a number of 0 or more and 10 or less, favorably 0 or more and 5 or less, with the proviso that m and n are not 0 at the same time.)

In many cases, $mH_2O$ represents an aqueous phase, which does not participate in the formation of a crystal lattice, but is eliminable, and so m may take a value of an integer or a value other than an integer. When the alumina hydrate is heated, m may reach a value of 0 in some cases.

As the crystal structure of the alumina hydrate, are known amorphous, gibbsite and boehmite types according to the temperature of a heat treatment. That having any crystal structure among these may be used as the alumina hydrate. Among these, favorable alumina hydrate is alumina hydrate exhibiting a boehmite structure or amorphous structure when analyzed by X-ray diffractometry. As specific examples thereof, may be mentioned the alumina hydrates described in Japanese Patent Application Laid-Open No. H07-232473, Japanese Patent Application Laid-Open No. H08-132731, Japanese Patent Application Laid-Open No. H09-66664 and Japanese Patent Application Laid-Open No. H09-76628, and commercially available products, Disperal HP14 (trade name, product of Sasol Co.) and Disperal HP18 (trade name, product of Sasol Co.).

The alumina hydrate used in the present invention favorably has a BET specific surface area of 100 m$^2$/g or more and 200 m$^2$/g or less as measured by the BET method. When the BET specific surface area falls within this range, the alumina hydrate can exhibit far excellent ink absorbency and colorability when mixed with gas phase process silica. Alumina hydrate having a BET specific surface area of 100 m$^2$/g or more and 175 m$^2$/g or less is more favorably used. When the BET specific surface area of the alumina hydrate is 120 m$^2$/g or more, the alumina hydrate can exhibit far excellent colorability. When the BET specific surface area is 160 m$^2$/g or less on the other hand, the alumina hydrate can exhibit far excellent ink absorbency.

Incidentally, the BET method is a method for measuring the surface area of powder by a gas-phase adsorption method, and is a method for determining a total surface area of 1 g of a sample, i.e., a specific surface area, from an adsorption isotherm by allowing the sample to adsorb an adsorption gas to use the adsorption amount thereof. At this time, the Brunauer-Emmett-Teller equation called the BET equation is used as that indicating the isotherm of multimolecular adsorption to determine the specific surface area. According to the BET method, the specific surface area is determined by finding an adsorption amount based on the BET equation and multiplying this value by an area occupied by one molecule adsorbed at the surface. In the BET method, the relationship between a certain relative pressure and an absorption amount is measured at several points by the nitrogen adsorption/desorption method, and the slope and intercept of the plots thereof are found by the method of least squares to derive the specific surface area. In the present invention, the relationship between a relative pressure and an absorption amount is measured at 5 points to derive the specific surface area.

In general, silica is roughly divided into wet process silica and dry process (gas phase process) silica according to the production process thereof. As for the wet process, a process in which active silica is formed by acid decomposition of a silicate and is then moderately polymerized followed by allowing it to cause aggregation and precipitation to obtain hydrous silica is mainly used. On the other hand, as for the dry process, a process in which anhydrous silica is obtained according to a process of subjecting a silicon halide to high temperature gas phase hydrolysis (flame hydrolysis process) or a process of heating, reducing and gasifying quartz sand and coke by arc in an electric furnace and oxidizing this product with air (arc process) is mainly used. The gas phase process silica is particularly high in ink absorbency and ink retention efficiency because of its particularly large specific surface area. In addition, since its refractive index is low, the silica is dispersed with a proper particle size, whereby transparency can be imparted to the resulting ink receiving layer, and so it is easy to achieve a high color density and good colorability. Thus, the gas phase process silica is favorable. The specific surface area of the gas phase process silica by the BET method is favorably 90 $m^2/g$ or more and 400 $m^2/g$ or less.

Examples of the binder include the following binders: starch derivatives such as oxidized starch, etherified starch and phosphoric acid esterified starch; cellulose derivatives such as carboxymethyl cellulose and hydroxyethyl cellulose; casein, gelatin, soybean protein and polyvinyl alcohol and derivatives thereof; polyvinyl pyrrolidone; maleic anhydride resins; latexes of conjugated polymers such as styrene-butadiene copolymers and methyl methacrylate-butadiene copolymers; latexes of acrylic polymers such as acrylic ester and methacrylic ester polymers; latexes of vinyl polymers such as ethylene-vinyl acetate copolymers; functional-group-modified polymer latexes obtained by modifying the above-described polymers with a monomer containing a functional group such as a carboxyl group; cationized polymers obtained by cationizing the above-described polymers with a cationic group; cationized polymers obtained by cationizing the surfaces of the above-described polymers with a cationic surfactant; polymers on the surfaces of which polyvinyl alcohol has been distributed obtained by polymerizing the above-described polymers in the presence of a cationic polyvinyl alcohol; polymers on the surfaces of which cationic colloid particles have been distributed obtained by polymerizing the above-described polymers in a suspended dispersion of the cationic colloid particles; aqueous binders such as thermosetting synthetic resins such as melamine resins and urea resins; polymer or copolymer resins of acrylic esters and methacrylic esters, such as polymethyl methacrylate; and synthetic resin binders such as polyurethane resins, unsaturated polyester resins, vinyl chloride-vinyl acetate copolymers, polyvinyl butyral and alkyd resins. These binders may be used either singly or in any combination thereof. Among these, polyvinyl alcohol is most favorable as the binder. This polyvinyl alcohol is favorably ordinary polyvinyl alcohol obtained by hydrolyzing polyvinyl acetate. Polyvinyl alcohol having an average polymerization degree of 1,500 or more is favorably used, and that having an average polymerization degree of 2,000 or more and 5,000 or less is more favorable. The saponification degree thereof is favorably 80 or more and 100 or less, more favorably 85 or more and 100 or less. Besides the above, modified polyvinyl alcohol such as polyvinyl alcohol cationically modified at the terminal thereof or anionically modified polyvinyl alcohol having an anionic group may also be used.

The mass ratio of the binder to the pigment in the ink receiving layer is favorably 1/10 or more and 10/1 or less in terms of the ratio binder/pigment. The ratio binder/pigment is more favorably 1/5 or more and 5/1 or less. In addition, the content of the pigment in the ink receiving layer is favorably higher than the content of the binder, i.e., the ratio binder/pigment is favorably less than 1/1.

The ink receiving layer may contain the following material: at least one of boric acid and a boric acid salt, for example. When boric acid and/or the boric acid salt are contained, the occurrence of cracking in the ink receiving layer can be inhibited. Examples of boric acid include orthoboric acid ($H_3BO_3$), metaboric acid and hypoboric acid. The boric acid salt is favorably a water-soluble salt of the boric acid. As specific examples of the boric acid salt, may be mentioned the following boric acid salts: alkali metal salts such as the sodium salts of boric acid ($Na_2B_4O_7.10H_2O$ and $NaBO_2.4H_2O$) and the potassium salts of boric acid ($K_2B_4O_7.5H_2O$ and $KBO_2$); ammonium salts of boric acid ($NH_4B_4O_9.3H_2O$ and $NH_4BO_2$)s; and the magnesium salts and calcium salts of boric acid. Among these boric acids and boric acid salts, orthoboric acid is favorably used from the viewpoints of long-term stability of the coating liquid and an inhibitory effect on occurrence of cracking. The amount of the boric acid used is favorably within a range of 10.0% by mass or more and 50.0% by mass or less in terms of solid content of the boric acid with respect to the binder in the resulting ink receiving layer. If the amount exceeds the above range, the long-term stability of the coating liquid may be lowered in some cases. More specifically, the coating liquid is used over a long period of time upon production of an ink-absorbent recording medium, and thus viscosity increase of the coating liquid and occurrence of gelled products may take place during use of the coating liquid in some cases if the content of the boric acid is too high. It is thus necessary to frequently conduct replacement of the coating liquid or cleaning of a coater head, so that productivity is markedly lowered. In addition, if the amount of the boric acid exceeds the above range, an uniform and good glossy surface may not be obtained on the resulting ink receiving layer in some cases. Incidentally, even when the amount of the boric acid used falls within the above range, cracks may occur in the ink receiving layer in some cases according to production conditions. It is thus necessary to suitably select the range of the amount used. Besides the above, the ink receiving layer may contain a cationic material typified by a cationic polymer as a dye fixer. The cationic polymer can improve the application property of a magenta dye in particular in the ink receiving layer to inhibit ink seeping out (migration) of the magenta dye typified by an anthrapyridone or quinacridone dye under a high-temperature and high-humidity environment.

Into the ink receiving layer coating liquid, may be suitably added, as a pH adjustor, for example, any one of the following acids and salts: formic acid, acetic acid, glycolic acid, oxalic acid, propionic acid, malonic acid, succinic acid, adipic acid, maleic acid, malic acid, tartaric acid, citric acid, benzoic acid, phthalic acid, isophthalic acid, terephthalic acid, glutaric acid, gluconic acid, lactic acid, asparagic acid, glutamic acid, pimelic acid, suberic acid, methanesulfonic acid, inorganic acids such as hydrochloric acid, nitric acid and phosphoric acid, and salts of the above-described acids. A monobasic acid is favorably used for dispersing the alumina hydrate in water. Therefore, among the above-described pH adjustors, an organic acid such as formic acid, acetic acid, glycolic acid or methanesulfonic acid, or an inorganic acid such as hydrochloric acid or nitric acid is favorably used. A pigment dispersant, a thickener, a flowability modifier, an antifoaming agent, a foam inhibitor, a surfactant, a parting agent, a penetrant, a coloring pigment and a coloring dye may also be added as other additives for coating liquid. In addition, a fluorescent whitening agent, an ultraviolet absorbent, an antioxidant, a preservative, a mildew-proofing agent, a waterproofing agent, a hardener and a weathering agent may also be added.

The peak in a pore radius distribution (pore radius) of the ink receiving layer is favorably 0.005 μm or more and 0.030 μm or less, more favorably 0.008 μm or more and 0.025 μm or less. The pore radius can be measured by the BJH (Barrett-Joyner-Halenda) method from an adsorption/desorption isotherm of nitrogen gas determined by subjecting a recording medium to measurement by the nitrogen adsorption/desorption method.

The ink receiving layer is favorably excellent in transparency. The haze value of the ink receiving layer when formed on a transparent film (haze value: 0%) is favorably 3% or more and 40% or less. The haze value can be measured by a hazeometer (trade name: NDH-2000, manufactured by Nippon Denshoku Kogyo K.K.).

The coating amount of the ink receiving layer coating liquid is favorably 10.0 g/m$^2$ or more and 50.0 g/m$^2$ or less. The coating amount is controlled to 10.0 g/m$^2$ or more, whereby an ink can be satisfactorily absorbed. The coating amount is controlled to 50.0 g/m$^2$ or less, whereby occurrence of cracking can be inhibited. Incidentally, the coating amount in the present invention is an absolute dry coating amount.

Surface Roughness:

In the recording medium according to the present invention, the arithmetic average roughness Ra2 of the outermost surface of the recording medium as prescribed by JIS B 0601:2001 is 0.3 μm or more and 2.5 μm or less. The Ra2 is controlled to 2.5 μm or less, whereby the occurrence of density unevenness in an image can be inhibited. The Ra2 is controlled to 0.3 μm or more, whereby light scattering can be moderately generated on the outermost surface of the recording medium to make the presence of scratches caused on the recording medium inconspicuous. The Ra2 is favorably 1.5 μm or less because the occurrence of density unevenness can be more inhibited. Incidentally, the outermost surface of the recording medium in the present invention means a surface, of the surfaces of the recording medium, on which an ink is applied to conduct recording. In the case of, for example, a recording medium having one ink receiving layer as an outermost layer on one surface of a substrate, the surface of the ink receiving layer on the opposite side to the substrate side is an outermost surface of the recording medium. In the case of a recording medium having an ink receiving layer as an outermost layer on each surface of a substrate, the surface of each ink receiving layer on the opposite side to the substrate side is an outermost surface of the recording medium.

In addition, the arithmetic average roughness of a surface of the substrate on the side of the ink receiving layer as prescribed by JIS B 0601:2001 is regarded as Ra1. At this time, Ra1−Ra2 is controlled to 2.0 μm or more to create such a state that the surface of the substrate has great unevenness, whereby light scattering can be markedly generated on the surface of the substrate to make the presence of scratches caused on the recording medium inconspicuous. The Ra1 is 2.3 μm or more from this relational expression. However, the Ra1 is favorably 3.0 μm or more for more strongly generating the light scattering. The Ra1 is favorably 7.0 μm or less from the viewpoint of easy formation of a recording medium.

In other words, in the recording medium according to the present invention, light is moderately scattered on the outermost surface of the recording medium within such a range that density unevenness in an image does not markedly occur. In addition, light is positively scattered on the surface of the substrate. As a result, they act synergistically to makes it possible to inhibit the occurrence of density unevenness in the image and make scratches inconspicuous.

No particular limitation is imposed on the recording medium having the characteristic surface roughness according to the present invention. However, such a recording medium is obtained according to, for example, the following production process.

Production Process of Recording Medium:

First, unevenness is embossed on the surface of a substrate. Description is given taking a case where a substrate obtained by coating a paper base material with a polyolefin resin is used as an example. As a method for embossing unevenness on the surface of the polyolefin resin, there is a method of coating a paper base material by extruding a molten polyolefin resin and then conducting patterning of fine unevenness on the surface of the polyolefin resin. Examples of a patterning method include a method of subjecting a substrate obtained by melt extrusion to an embossing calender treatment at a temperature close to room temperature and a method of forming unevenness while cooling by means of a cooling roll with the surface of the roll engraved with a pattern upon extrusion coating of a polyolefin resin. The latter method is favorable because the embossing can be conducted under a relatively low pressure, and exacter and evener embossing can be conducted. The surface roughness Ra1 of a resin-coated substrate used in a general recording medium and obtained by coating a base material with a resin is of the order of from 0.1 μm to 1.5 μm. In other words, light scattering on the surface of the substrate is not sufficiently achieved, so that there is a tendency for scratches to be conspicuous. Thus, it is favorable to control the Ra1 by intentionally forming unevenness on the surface of the substrate using such a method as described above.

A method for controlling the arithmetic average roughness Ra2 of the outermost surface of the recording medium to 0.3 μm or more and 2.5 μm or less will now be described. In a general recording medium, i.e., a recording medium having an ink receiving layer formed by applying a coating liquid containing a pigment having a particle size of about several nm and a binder so as to give a coating thickness of about 40 μm or less, i.e., a coating amount of about 40 g/m$^2$ or less, the surface of the ink receiving layer becomes an outermost surface of the recording medium. In this case, the Ra2 of the surface of the ink receiving layer, i.e., the outermost surface of the recording medium, follows the surface roughness Ra1 of the substrate. As a result, Ra1−Ra2 tends to be 1.0 μm or less. For example, when the surface of the ink receiving layer is an outermost surface of the recording medium, the following methods (1) and (2) are mentioned as methods for controlling the arithmetic average roughness Ra2 of the outermost surface to 0.3 μm or more and 2.5 μm or less.

(1) A method of thickening an ink receiving layer coating liquid applied on the substrate; and (2) A method of smoothening the outermost surface of a recording medium formed on the substrate by a calendering device.

The method (1) is a method in which the substrate is coated with the ink receiving layer coating liquid and the ink receiving layer coating liquid is thickened to form an ink receiving layer. In the recording medium according to the present invention, the ink receiving layer is provided on the substrate. However, the substrate may not come into direct contact with the ink receiving layer. Therefore, such a precoat layer as described below may be provided between the substrate and the ink receiving layer.

For example, a coating liquid containing a component for thickening the ink receiving layer coating liquid (precoat coating liquid) is first applied on to the substrate. The ink receiving layer coating liquid is then applied on to a wet surface when the precoat coating liquid is in a wet state or on to a dry layer when the precoat coating liquid is dried and solidified to form a layer (precoat layer). As a result, the ink receiving layer coating liquid can be thickened immediately after the application to form an ink receiving layer having a smooth surface profile that does not depend on the surface profile of the substrate.

The precoat coating liquid favorably contains a basic component and a crosslinking component. These components can efficiently thicken the binder in the ink receiving layer. When alumina hydrate as an inorganic pigment and polyvinyl alcohol as a binder are used in the ink receiving layer coating liquid, examples of the basic component include hydroxides and salts of alkali metals and alkaline earth metals, such as lithium hydroxide, calcium hydroxide, magnesium hydroxide, calcium carbonate and sodium borate. Examples of the crosslinking component for thickening the binder include boron compounds. Borax, boric acid or a boric acid salt is favorable in that a crosslinking reaction can be quickly caused. No particular limitation is imposed on the coating amount of the precoat coating liquid, and the coating amount may be suitably controlled according to the kinds of the basic component and crosslinking component. For example, when the precoat coating liquid contains sodium tetraborate, the coating amount of the precoat coating liquid is favorably controlled in such a manner that the dry coating amount of sodium tetraborate is 0.05 g/m$^2$ or more and 2.0 g/m$^2$ or less.

As another method, there is a method of applying an ink receiving layer coating liquid exhibiting a thickening property at a low temperature, drying the coating liquid while being in an immobilized state by low-temperature drying and then gradually raising the temperature to dry the coating liquid.

The method (2) is a method in which the substrate is coated with the ink receiving layer coating liquid, and the surface of the ink receiving layer is then smoothened by means of a smoothening treatment by any one of various calendering devices. The smoothening treatment by the calendering device can be conducted by means of a calendering device such as a machine calender, TG calender, super calender or soft calender. The surface roughness, surface temperature and diameter of a roll in the calendering device, a pressure (linear pressure) upon the treatment, and a treating speed may be suitably selected.

The ink receiving layer coating liquid contains, for example, the above-described pigment and binder. A specific example thereof is a liquid containing alumina hydrate, polyvinyl alcohol (PVA) and boric acid. The ink receiving layer coating liquid is applied on to the substrate and dried, thereby forming an ink receiving layer. The ink receiving layer coating liquid is favorably an aqueous dispersion having an average particle size of 50 nm or more and 300 nm or less obtained by conducting fine granulation by means of a dispersing machine. As the dispersing machine used for obtaining the aqueous dispersion, may be used conventionally known various dispersing machines such as rotating dispersing machines, medium-stirring type dispersing machines (for example, ball mill and sand mill), ultrasonic dispersing machines, colloid mill dispersing machines and high-pressure dispersing machines. In the present invention, the ink receiving layer coating liquid is favorably an acid solution, and the pH thereof is favorably 6.0 or less, more favorably 5.0 or less. This pH is adjusted by suitably selecting the kind of an organic or inorganic acid, which is a pH adjustor, or of a cationic resin and the use amount thereof. When the pH of the coating liquid is 6.0 or less, a crosslinking reaction of a water-soluble resin by a crosslinking agent in the coating liquid can be well inhibited. In the coating of the coating liquid, for example, the following method can be used, and the coating is conducted by on-machine or off-machine coating using any one of, for example, various kinds of curtain coaters, a coater using an extrusion system and a coater using a slide hopper system. Upon the coating, the coating liquid may be heated or a coater head may be heated for the purpose of adjusting the viscosity of the coating liquid. For example, a hot air dryer such as a linear tunnel dryer, arch dryer, air loop dryer or sine curve air float dryer may be used for drying of the coating liquid after the coating. In addition, an infrared heating dryer or a dryer utilizing microwaves is suitably chosen for use.

The precoat coating liquid is a liquid containing the above-described basic component and crosslinking component. The precoat coating liquid is used as an alkaline solution, whereby the thickening of the ink receiving layer coating liquid can be more accelerated. Accordingly, the pH of the precoat coating liquid is adjusted to favorably 7.1 or more, more favorably 7.5 or more. If the pH is too close to the acid side, the crosslinking reaction of the binder contained in the coating liquid by the crosslinking agent is not sufficiently conducted, and so it is difficult to thicken the ink receiving layer coating liquid. The precoat coating liquid is, for example, a liquid containing ion-exchanged water and at least one selected from the group consisting of boric acid and a boric acid salt. In addition, the precoat coating liquid favorably contains a water-soluble polymer or polymer latex capable of forming a film for improving adhesion to the surface of the substrate. Specifically, a water-soluble polymer such as gelatin, polyvinyl alcohol, polyvinyl pyrrolidone or water-soluble cellulose may be used. Further, the precoat coating liquid favorably contains a surfactant. Furthermore, the surface of the substrate is favorably subjected to a corona discharge treatment prior to coating the substrate with the precoat coating liquid. By this treatment, it is easy to uniformly coat the surface of the substrate with the precoat coating liquid.

The present invention will hereinafter be described more specifically by the following Examples and Comparative Examples. However, the present invention is not limited to these examples. Incidentally, "parts" or "part" and "%" are based on the mass unless expressly noted.

Measurement of arithmetic average roughness Ra was conducted under the following measuring conditions by means of the following measuring apparatus.

Measuring apparatus: Surfcorder SE3500 (manufactured by Kosaka Laboratory, Ltd.)

Measuring conditions: The measurement was conducted by setting a cutoff value according to JIS B 0601:2001 and conducting evaluation with the length 5 times as much as the cutoff value as an evaluation length.

Preparation of Substrate

Twenty parts of precipitated calcium carbonate was added into a slurry of 100 parts of Laubholz bleached kraft pulp, 2 parts of cationized starch and 0.3 parts of an alkenylsuccinic anhydride neutral sizing agent were added, and these components were sufficiently mixed to prepare a paper stock. This paper stock was dried to a water content of 10% by means of a Fourdrinier multi-cylinder paper machine, and a 7% solution of oxidized starch was applied to both sides of the dried product by a size press so as to give a coating amount of 4 g/m$^2$ in total. The thus-coated product was further dried to a water content of 7% to prepare a paper base material having a basis weight of 110 g/m$^2$. A resin composition composed of 70 parts of low density polyethylene and 20 parts of high density polyethylene was applied to both sides of the thus-prepared paper base material by melt extrusion so as to give a coating amount of 30.0 g/m$^2$ on one side. Just after the application, the polyethylene surfaces were subjected to five embossing treatments using cooling rolls having unevennesses of irregular profiles different from one another on their surfaces while cooling. Differences among the embossing treatments were created by adjusting the density and the height between dented and protruded portions. In this manner, substrates A to E each having a basis weight of 170 g/m$^2$ were prepared. The Ra1 of each substrate is shown in Table 1. Incidentally, both surfaces of the substrate had the values shown in Table 1.

TABLE 1

| | Ra1 (μm) |
|---|---|
| Substrate A | 0.8 |
| Substrate B | 3.0 |
| Substrate C | 4.3 |
| Substrate D | 6.2 |
| Substrate E | 8.0 |

Preparation of Ink Receiving Layer Coating Liquid A

Alumina hydrate (trade name: Disperal HP14, product of Sasol Co.) was added into ion-exchanged water so as to give a concentration of 30%. Methanesulfonic acid was then added in an amount of 1.5% based on this alumina hydrate, and the resultant mixture was stirred to obtain a colloidal sol. The resultant colloidal sol was diluted with ion-exchanged water in such a manner that the proportion of the alumina hydrate is 27%, thereby obtaining colloidal sol A.

On the other hand, polyvinyl alcohol (trade name: PVA 235, product of Kuraray Co., Ltd.; polymerization degree: 3,500, saponification degree: 88%) was dissolved in ion-exchange water to obtain a 8.0% aqueous solution of polyvinyl alcohol. The resultant polyvinyl alcohol solution was mixed with colloidal sol A in such a manner that the proportion of polyvinyl alcohol is 10.0% based on the alumina hydrate. A 3.0% aqueous solution of boric acid was then mixed with the resultant mixture in such a manner that the proportion of boric acid is 2.0% based on the alumina hydrate, thereby preparing an ink receiving layer coating Liquid A.

Preparation of Ink Receiving Layer Coating Liquid B

One hundred parts of silica (trade name: A300, product of Nippon Aerosil Co., Ltd.) and 4 parts of a cationic polymer (trade name: SHALLOL DC902P, product of DAI-ICHI KOGYO SEIYAKU CO., LTD.) were dispersed in ion-exchanged water so as to give a solid content concentration of 18%, and the resultant mixture was dispersed by a high-pressure homogenizer to obtain colloidal sol B.

On the other hand, polyvinyl alcohol (trade name: PVA 235, product of Kuraray Co., Ltd.; polymerization degree: 3,500, saponification degree: 88%) was dissolved in ion-exchange water to obtain a 8.0% aqueous solution of polyvinyl alcohol. The resultant polyvinyl alcohol solution was mixed with colloidal sol B in such a manner that the proportion of polyvinyl alcohol is 20.0% based on the silica. A 3.0% aqueous solution of boric acid was then mixed with the resultant mixture in such a manner that the proportion of boric acid is 3.5% based on the silica, thereby preparing an ink receiving layer coating Liquid B.

Preparation of Precoat Coating Liquid A:

Ion-exchanged water was added to a mixture of 20 g of a 10% aqueous solution of acidic-treated gelatin and 0.15 g of isopropanol in such a manner that the total amount is 100 g, thereby preparing a precoat coating liquid A.

Preparation of Precoat Coating Liquid B:

Ion-exchanged water was added to a mixture of 3.0 g of sodium tetraborate, 20 g of a 10% aqueous solution of acidic-treated gelatin and 0.15 g of isopropanol in such a manner that the total amount is 100 g, thereby preparing a precoat coating liquid B.

Examples 1 to 7 and Comparative Example 1 to 18

After each of the substrates A to E was subjected to a high frequency corona discharge treatment, the precoat coating liquid was applied on to the substrates to form a precoat layer. The ink receiving layer coating liquid was then applied on to the precoat layer to thicken the ink receiving layer coating liquid and form an ink receiving layer, thereby preparing respective recording media. The constructions and surface roughnesses of the respective recording media are as shown in the following Table 2. Incidentally, Example 5 and Comparative Example 11 are examples where precoat coating liquids and ink receiving layer coating liquids of the same compositions were applied on to both sides of the substrate to form ink receiving layers of the same composition on both sides. However, the coating amount shown in Table 2 is a coating amount on one side. In other examples, the precoat coating liquid and ink receiving layer coating liquid were applied on to only one side of the substrate to form an ink receiving layer. The respective recording media were subjected to the following evaluations, and the evaluated results thereof are shown in Table 2.

Evaluations:

The respective recording media prepared were subjected to the following evaluations. Three recording media of the same kind were first provided. The following images 1 to 3 were then respectively recorded on the ink receiving layers of these recording media with a gloss Pro-Platinum grade mode (standard setting, color/density: non-matched) by means of an ink jet recording apparatus (trade name: PIXUS MP990, manufactured by Canon Inc.).

Image 1: Image solid-printed on a region of 10 cm by 10 cm at (R,G,B)=(0,255,255) by the RGB mode of PhotoShop 7.0.

Image 2: Image solid-printed on a region of 15 cm by 15 cm at (R,G,B)=(0,0,0) by the RGB mode of PhotoShop 7.0.

Image 3: Image solid-printed on a region of 5 cm by 5 cm at (R,G,B)=(255,255,0) by the RGB mode of PhotoShop 7.0.

Density Unevenness:

After the image 1 was recorded, the recording medium was dried for 24 hours under an environment of 23° C. and 50% RH. After the drying, the occurrence of density unevenness in the image 1 was visually evaluated according to the following criteria.

A: No occurrence of density unevenness can be observed;

B: Occurrence of density unevenness can be slightly observed;

C: Occurrence of density unevenness can be clearly observed.

Scratch:

After the images 2 and 3 were recorded, the recording media were dried for 24 hours under an environment of 23° C. and 50% RH. After the drying, the images 2 and 3 were put together, and a weight of 1.5 g/m$^2$ was placed thereon to conduct the operation of rubbing both images together by a stroke of about 3 cm repeatedly 50 times. Thereafter, scratches on the image 2 were visually evaluated according to the following criteria.

A: No scratch can be observed;

B: Scratches can be slightly observed;

C: Scratches can be clearly observed.

TABLE 2

| | | Substrate | Precoat layer Coating liquid | Precoat layer Coating amount (g/m$^2$) | Ink receiving layer Coating liquid | Ink receiving layer Coating amount (g/m$^2$) | Ra1 (μm) | Ra2 (μm) | Ra1-Ra2) (μm) | Density uneven-ness | Scratch |
|---|---|---|---|---|---|---|---|---|---|---|---|
| Example | 1 | B | B | 0.40 | A | 35.0 | 3.0 | 0.9 | 2.1 | A | B |
| | 2 | B | B | 0.50 | B | 30.0 | 3.0 | 0.6 | 2.4 | A | B |
| | 3 | C | B | 0.40 | A | 35.0 | 4.3 | 1.1 | 3.2 | A | A |
| | 4 | C | B | 0.50 | B | 30.0 | 4.3 | 0.7 | 3.6 | A | A |
| | 5 | C | B | 0.60 | A | 35.0 | 4.3 | 0.5 | 3.8 | A | A |
| | 6 | D | B | 0.50 | B | 30.0 | 6.2 | 2.4 | 3.8 | B | A |
| | 7 | D | B | 0.60 | A | 35.0 | 6.2 | 1.7 | 4.5 | B | A |
| Comparative Example | 1 | A | A | 0.08 | A | 35.0 | 0.8 | 0.4 | 0.4 | A | C |
| | 2 | A | B | 0.20 | A | 35.0 | 0.8 | 0.3 | 0.5 | A | C |
| | 3 | A | B | 0.40 | A | 35.0 | 0.8 | 0.3 | 0.5 | A | C |
| | 4 | A | B | 0.50 | B | 30.0 | 0.8 | 0.3 | 0.5 | A | C |
| | 5 | B | A | 0.08 | A | 35.0 | 3.0 | 2.4 | 0.6 | B | B |
| | 6 | A | B | 0.60 | A | 35.0 | 0.8 | 0.2 | 0.6 | A | C |
| | 7 | C | A | 0.08 | A | 35.0 | 4.3 | 3.5 | 0.8 | C | A |
| | 8 | D | A | 0.08 | A | 35.0 | 6.2 | 5.4 | 0.8 | C | A |
| | 9 | E | A | 0.08 | A | 35.0 | 8.0 | 7.2 | 0.8 | C | A |
| | 10 | B | B | 0.20 | A | 35.0 | 3.0 | 1.5 | 1.5 | B | B |
| | 11 | C | B | 0.20 | A | 35.0 | 4.3 | 2.8 | 1.5 | C | A |
| | 12 | D | B | 0.20 | A | 35.0 | 6.2 | 4.7 | 1.5 | C | A |
| | 13 | E | B | 0.20 | A | 35.0 | 8.0 | 6.5 | 1.5 | C | A |
| | 14 | B | B | 0.60 | A | 35.0 | 3.0 | 0.2 | 2.8 | A | C |
| | 15 | D | B | 0.40 | A | 35.0 | 6.2 | 3.0 | 3.2 | C | A |
| | 16 | E | B | 0.40 | A | 35.0 | 8.0 | 4.8 | 3.2 | C | A |
| | 17 | E | B | 0.50 | B | 30.0 | 8.0 | 4.3 | 3.7 | C | A |
| | 18 | E | B | 0.60 | A | 35.0 | 8.0 | 3.5 | 4.5 | C | A |

As shown in Table 2, the recording media of Examples 1 to 7 were evaluated as A in either Density unevenness or Scratch and as B or higher in both, and so these recording media could achieve inhibition of both occurrence of density unevenness and conspicuousness of scratches.

On the other hand, the recording media of Comparative Examples 1 to 4 and 6, in which Ra1−Ra2 is smaller than 2.0 μm and Ra2 is smaller than 1.0 μm, were evaluated as C in Scratch. The recording media of Comparative Examples 5 and 10, in which Ra1−Ra2 is smaller than 2.0 μm though Ra2 is 1.0 μm or more, were evaluated as B in both Density unevenness and Scratch. The recording media of Comparative Examples 7 to 9, 11 to 13, and 15 to 18, in which Ra2 is greater than 2.5 μm, were evaluated as C in Density unevenness. The recording medium of Comparative Example 14, in which Ra2 is smaller than 0.3 μm though Ra1−Ra2 is 2.0 μm or more, was evaluated as C in Scratch.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-129271, filed Jun. 4, 2010, which is hereby incorporated by reference herein in its entirety.

What is claimed is:

1. A recording medium comprising a substrate and an ink receiving layer provided on the substrate, wherein the substrate is a resin-coated substrate obtained by coating a base material with a resin, and wherein Ra2 is 0.3 μm or more and 2.5 μm or less and Ra1−Ra2 is 2.0 μm or more, where Ra1 is an arithmetic average roughness of a surface of the substrate on the side of the ink receiving layer as prescribed by JIS B 0601:2001 and Ra2 is an arithmetic average roughness of the outermost surface of the recording medium as prescribed by JIS B 0601:2001.

2. The recording medium according to claim 1, wherein Ra1−Ra2 is 3.0 μm or more.

3. The recording medium according to claim 2, wherein Ra1 is 2.3 μm or more.

4. The recording medium according to claim 3, wherein Ra1 is 3.0 μm or more.

5. The recording medium according to claim 4, wherein Ra1 is 7.0 μm or less.

6. The recording medium according to claim 5, wherein Ra2 is 1.5 μm or less.

7. The recording medium according to claim 1, wherein Ra2 is 1.5 μm or less.

8. A process for producing the recording medium according to claim 1, which comprises coating the substrate with an ink receiving layer coating liquid and thickening the ink receiving layer coating liquid to form an ink receiving layer.

* * * * *